United States Patent [19]

Pyle

[11] Patent Number: 4,503,994

[45] Date of Patent: Mar. 12, 1985

[54] FIBER OPTIC FUEL SHUTOFF SYSTEM

[75] Inventor: Walter R. Pyle, Richmond, Calif.

[73] Assignee: Chevron Research Company, San Francisco, Calif.

[21] Appl. No.: 80,591

[22] Filed: Oct. 1, 1979

[51] Int. Cl.[3] ..... B67D 5/08

[52] U.S. Cl. ..... 222/64; 222/52; 250/577; 141/198

[58] Field of Search ..... 222/64, 52; 250/577; 141/198

[56] References Cited

U.S. PATENT DOCUMENTS 3,662,924 5/1972 Crandall et al. ..... 222/64

4,069,838 1/1978 Hansel et al. ..... 250/577 X 4,119,860 10/1978 Gooley ..... 250/577

4,156,149 5/1979 Vaccari ..... 250/577

*Primary Examiner*—Joseph J. Rolla

*Attorney, Agent, or Firm*—S. R. LaPaglia; E. J. Keeling; P. L. McGarrigle

[57] ABSTRACT

An automatic fuel shutoff system for preventing fuel flow into a tank being filled when the level of fuel in the tank reaches a predetermined level. This system stops fuel flow when the passage of light from a light transmitter to a light receiver is blocked by the presence of fuel in a detector gap formed near the outlet of a fuel-dispensing nozzle.

2 Claims, 5 Drawing Figures

FIBER OPTIC FUEL SHUTOFF SYSTEM

FIELD OF THE INVENTION

The present invention is directed to fuel-dispensing nozzles for dispensing fuel into vehicle fuel tanks, and more particularly, to a fibre optic fuel shutoff system for preventing the flow of fuel into the tank being filled when the level of fuel in the tank rises above a predetermined level.

BACKGROUND OF THE INVENTION

Fuel-dispensing nozzles normally include a shutoff system for automatically stopping the flow of fuel into the container being filled when the level of fuel in the container reaches a predetermined level. In service station operations where the discharge spout of the fuel nozzle is inserted into the fill pipe of a vehicle fuel tank, the fuel nozzle is normally arranged to be manually latched in an open position and to automatically close when the fuel tank is substantially filled.

Nozzle automatic fuel shutoff systems used heretofore have incorporated some sort of vacuum-operated mechanism to automatically close the nozzle flow control valve when normal venting of the vacuum mechanism by way of a vent tube is interrupted. In these arrangements, the vent tube extends from the vacuum mechanism in the nozzle main body portion and through the discharge spout of the fuel nozzle to a vent passage opening at the outlet end of the discharge spout. When the level of fuel in the tank being filled rises to a level sufficient to block the vent passage opening, the vacuum mechanism is actuated to close the flow control valve. With the flow control valve closed, the flow of fuel through the nozzle is stopped. Examples of these vacuum-operated shutoff systems may be found in U.S. Pat. No. 4,142,562, U.S. Pat. No. 4,131,140, U.S. Pat. No. 4,058,149, and U.S. Pat. No. 3,176,980.

The vacuum-operated shutoff systems are fairly complicated mechanical arrangements, and as such, present manufacture and maintenance problems. On the other hand, the present invention offers a relatively simple automatic fuel shutoff system which greatly reduces the number of moving parts that have to be built into any particular fuel nozzle. Thus, this system is relatively inexpensive to build and maintain.

SUMMARY OF THE INVENTION

Broadly speaking, the present invention is directed to a fibre optic automatic fuel shutoff system. The present invention comprises a light source means and a light receiver means arranged at some point remote from the fuel-dispensing nozzle. A first light conduit extends from the light source means to near the outlet end of the nozzle discharge spout. A second light conduit extends from the light receiver means to a point near the outlet end of the discharge spout to define a detector gap with the first light conduit. A housing is formed in the discharge spout to define a chamber in which the detector gap is located. Fuel may only enter the chamber through an opening in the lower surface of the discharge spout that communicates with fuel in the fill pipe of the tank being filled.

A fuel flow shutoff means is provided at the fuel dispenser of the fuel dispensing system to prevent the flow of fuel into the tank being filled when the level of fuel in the tank rises above a predetermined level. That is to say, when the fuel in the tank is at level where it enters the chamber in which the detector gap is located. The fuel flow shutoff means may comprise a normally closed valve arranged in that portion of the flow passage extending through the fuel dispenser. The valve will be open when light is received by the receiver's photocell and closed to prevent fuel flow when the passage of light to the photocell is blocked by the presence of fuel in the detector gap. The sutoff means may also comprise a means for preventing operation of the fuel supply pump when fuel is in the detector gap.

PRINCIPLE OBJECT OF THE INVENTION

A particular object of the present invention is to provide an automatic fuel shutoff system for a liquid fuel dispensing nozzle in which fuel flow into the fuel tank being filled is automatically stopped when the level of fuel in the tank is such that fuel enters a detector gap to block the passage of light therethrough from a light source to a light receiver.

Additional objects and advantages of the invention will become apparent from a detailed reading of the specification and drawings which are incorporated herein and made a part of this specification.

DESCRIPTION OF THE PREFERRED EMBODIMENT

For illustrative purposes, the present invention is described with respect to a fuel-dispensing nozzle that does not incorporate a vapor-recovery system. It is noted, however, that the invention may be used on vapor-recovery nozzles.

Figures 1, 2:
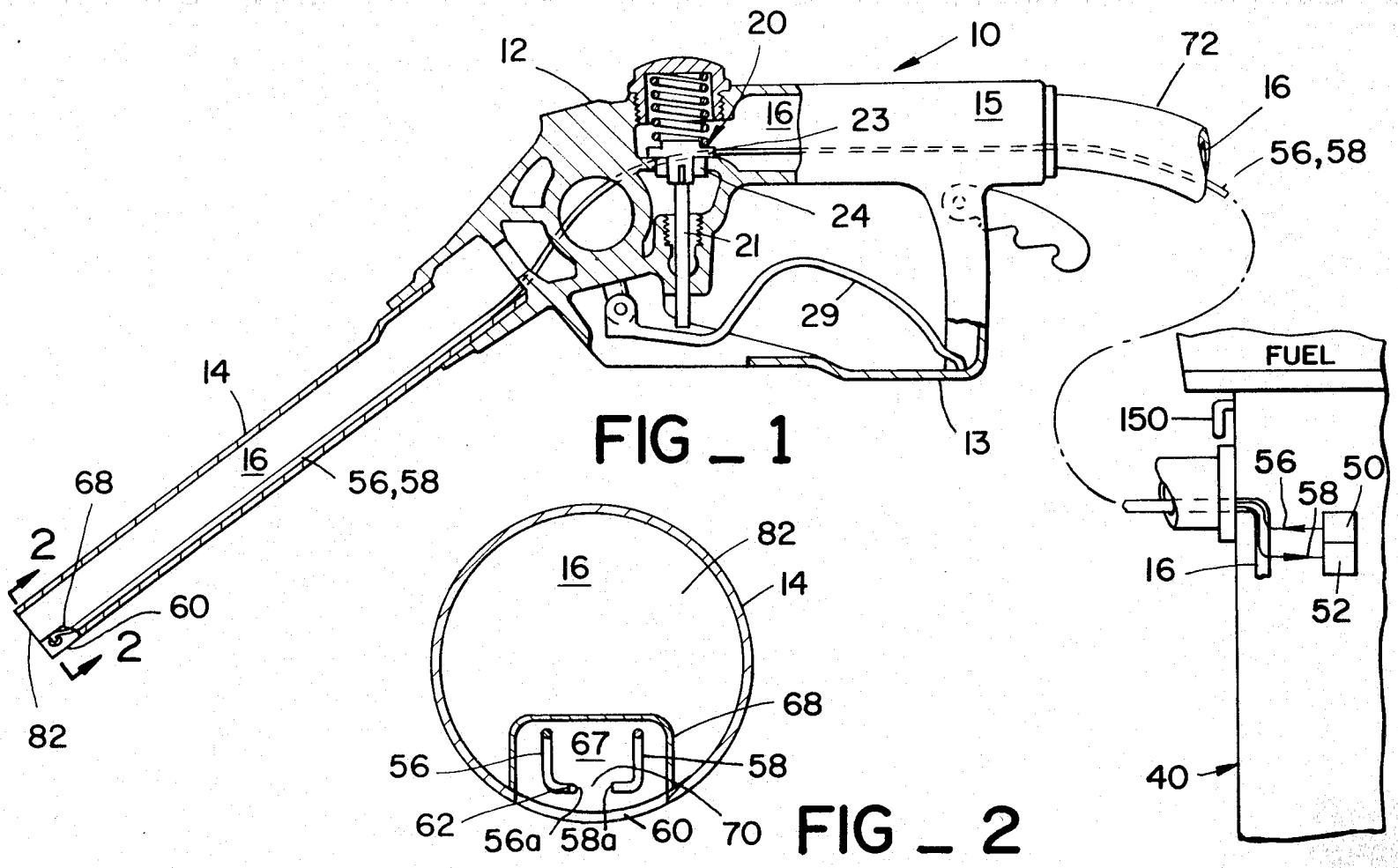
FIG. 1 is a cross-sectional view of fuel-dispensing nozzle that is connected to a fuel dispenser.
FIG. 2 is an enlarged cross-sectional view along line 2—2 of FIG. 1.
Figure 3A:
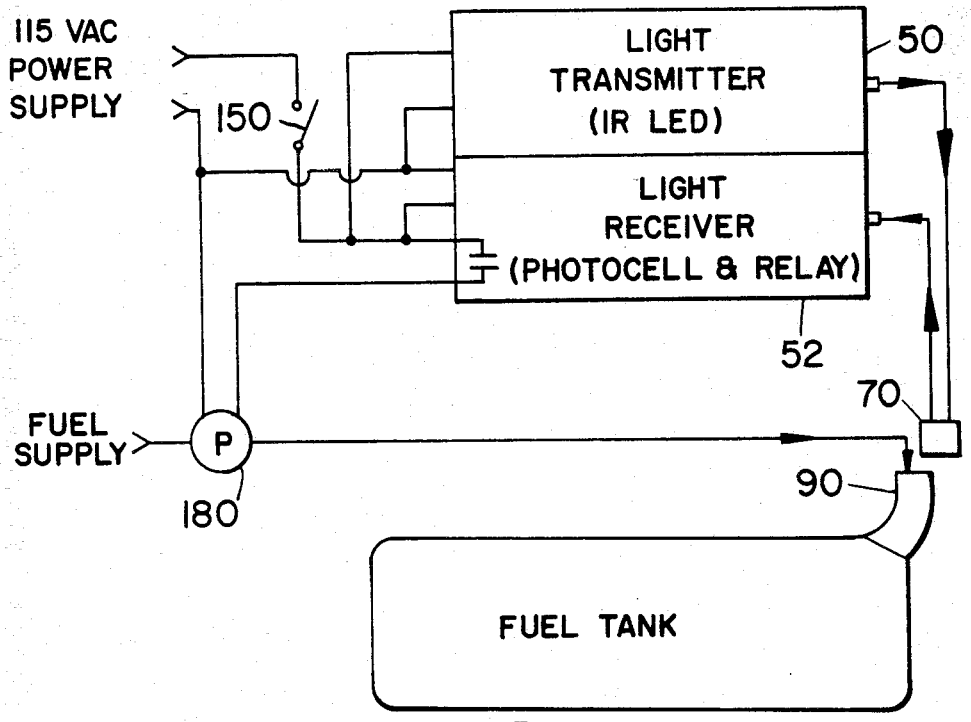
FIG. 3*a* is a block diagram illustrating various elements of the fuel shutoff system wherein the fuel flow shutoff means comprises means for stopping operation of the fuel supply pump.
Figure 3B:
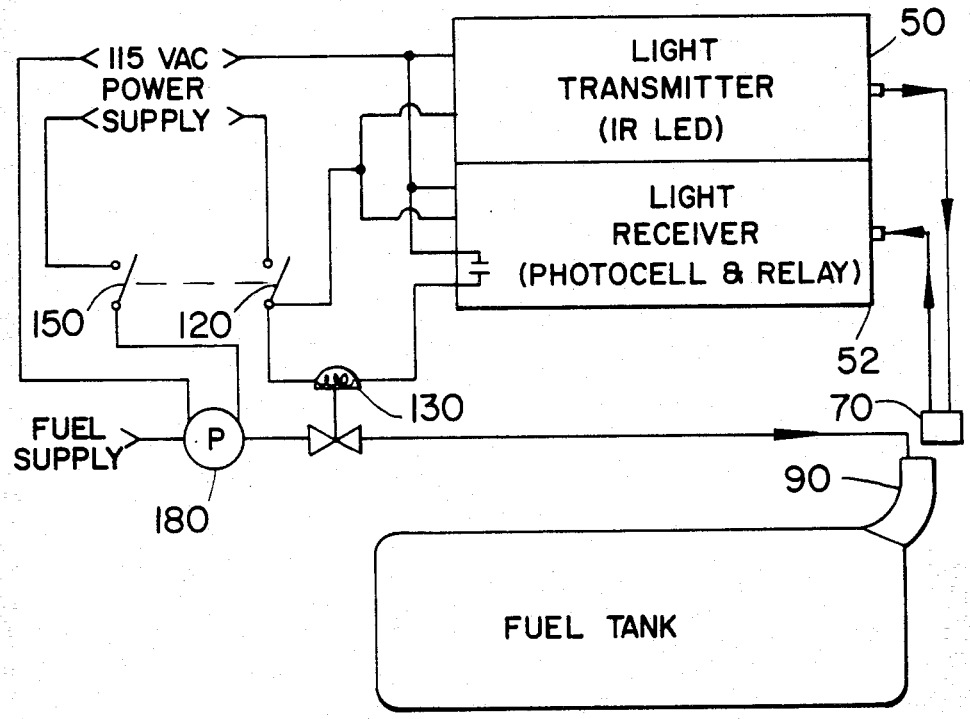
FIG. 3*b* is a block diagram illustrating various elements of the fuel shutoff system wherein the fuel flow shutoff means is a valve arranged in the fuel flow path in the fuel dispenser.

Now referring to the drawings, FIG. 1 represents a fuel-dispensing nozzle 10 having a main body portion 12 with open-end discharge spout 14 projecting from the nozzle main body portion for insertion into the fill pipe 90 of a vehicle fuel tank. The discharge spout has an outlet end 82 through which fuel flows into the fuel tank and which is proportioned for each of insertion into the fuel tank fill pipe. A fuel hose 72 is connected between the nozzle 10 and a fuel dispenser or gasoline service pump 40. Fuel flows from the fuel dispenser to the fuel tank through a fuel flow passage, indicated generally by reference numeral 16, that extends through the fuel dispenser, fuel hose 72, nozzle main body portion 12, and discharge spout 14.

A flow control valve, indicated by reference numeral 20, is located in that portion of flow passage 16 extending through the nozzle main body portion. The flow control valve opens and closes the passage through the nozzle main body portion to regulate the flow of fuel through the passage. When the fuel dispenser 40 is turned on by closing fuel pump power switch 150, flow control valve 20 may be oerated to flow fuel through flow passage 16. The flow control valve is operated by squeezing lever 29 in the direction toward handle 15. When lever 29 is squeezed toward handle 15, the flow control valve plunger 21 is moved in an upward direction lifting flow control valve head 23 from flow control valve seat 24. This permits fuel to flow through the flow passage downstream of valve 20 and into the fuel tank being filled. A guard 13 may be provided to protect lever 29 as well as to provide a support for holding the nozzle when it is stored in the fuel dispenser when not in use.

The fuel dispensing system further includes an automatic shutoff system for stopping the flow of fuel into the container or fuel tank being filled when the level of fuel in the tank reaches a predetermined level. The automatic shutoff system of the present invention is different from prior art systems in that it incorporates a fibre optic system for stopping fuel flow. Unlike the prior art systems, the present invention does not use a vacuum-operated mechanism to close flow control valve 20 when normal venting of the vacuum mechanism by way of a vent tube is interrupted by fuel blocking the vent tube's vent passage opening.

The system of the present invention includes a light source or transmitter 50 and a light detector or receiver 52 arranged at fuel dispenser 40. The light source is preferably a light-emitting diode. The light receiver comprises a photocell and a relay, the operation of which will be discussed in detail below. Light is transmitted from light source 50 through a first fibre optic light guide or conduit 56. Light is received by receiver 52 through a second fibre optic light guide or conduit 58. Light guide 56 extends from transmitter 50 and through flow passage 16 to a point adjacent to a port or opening 60 formed in the lower surface of the discharge spout near the outlet end thereof. Likewise, light guide 58 extends from receiver 52 to a point adjacent to port 60 but spaced apart from light guide 56.

To explain more fully, light guides 56 and 58 extend into a housing 68, see FIG. 2, formed near outlet end 82 of the discharge spout. Housing 68 forms with the lower surface of the discharge spout a fuel-tight enclosure that defines a chamber 67 that fuel can only enter through opening or port 60. Accordingly, the point at which the light guides pass through the walls of the housing is provided with appropriate packing to prevent the passage of fuel therethrough. Port 60 extends through the lower surface of the discharge spout and is of sufficient cross-sectional area to permit the free flow of fuel into and out of chamber 67. This allows fuel to rapidly drain from chamber 67 when the nozzle is removed from the fill pipe and to easily enter the chamber when the fuel level in the tank being filled rises to port 60. Preferably, the dimensions of port 60 approximate those of housing 68.

As noted, light guides 56 and 58 extend into chamber 67 where the ends of the light guides **56*a* and 58*a* are arranged to form a space or detector gap 70 between the two light guides. A focusing lens 62 may be provided at light guide end 56*a* so that focal point of the light travelling out of conduit 56 is at end 58*a*. In addition, a collecting lens, which is not illustrated, could be provided at light guide end 58*a* so that light traveling out of light guide end 56*a* converges to a point to pass through conduit 58. It is noted, however, that if detector gap 70** is small enough, neither lens would have to be used.

In operation of the present invention, pump power switch 150, see FIG. **3*a*, of dispenser 40 is closed to turn on fuel supply pump 180 and fibre optic light source 50. Power to pump 180 is supplied through closed relay 57 of receiver 52. Relay 57 is normally open and is operated to be in its closed position by the power generated by the receiver's photocell. The photocell generates power in response to incident light received from light source 50. Light from light source 50 travels to receiver 52 through conduits 56 and 58 and passes across detector gap 70**. The power generated by the photocell is also amplified by an appropriate circuit so that sufficient power is available to maintain the relay in its closed position.

With pump 180 on, fuel flow valve 20 may be operated to flow fuel into the tank being filled. If no fuel enters chamber 67, light is free to travel from source 50 across gap 70 and to receiver 56. And as noted, light reaching the receiver's photocell will cause sufficient power to be generated to maintain relay 57 in its closed position and thus to keep pump 180 on. However, should the level of fuel in the tank being filled rise to a level where it reaches the end of the discharge spout to flow into chamber 67 through opening 60 to be present in detector gap 70, fuel flow will be automatically stopped. This occurs because the passage of light from light source 50 to light receiver 52 is blocked by the presence of fuel in detector gap 70. When light does not reach receiver 52, the receiver's photocell does not generate power to maintain relay 57 in its closed position. Thus, relay 57 will open, automatically turning off pump 180 and shutting off the fuel flow.

Figure 4:
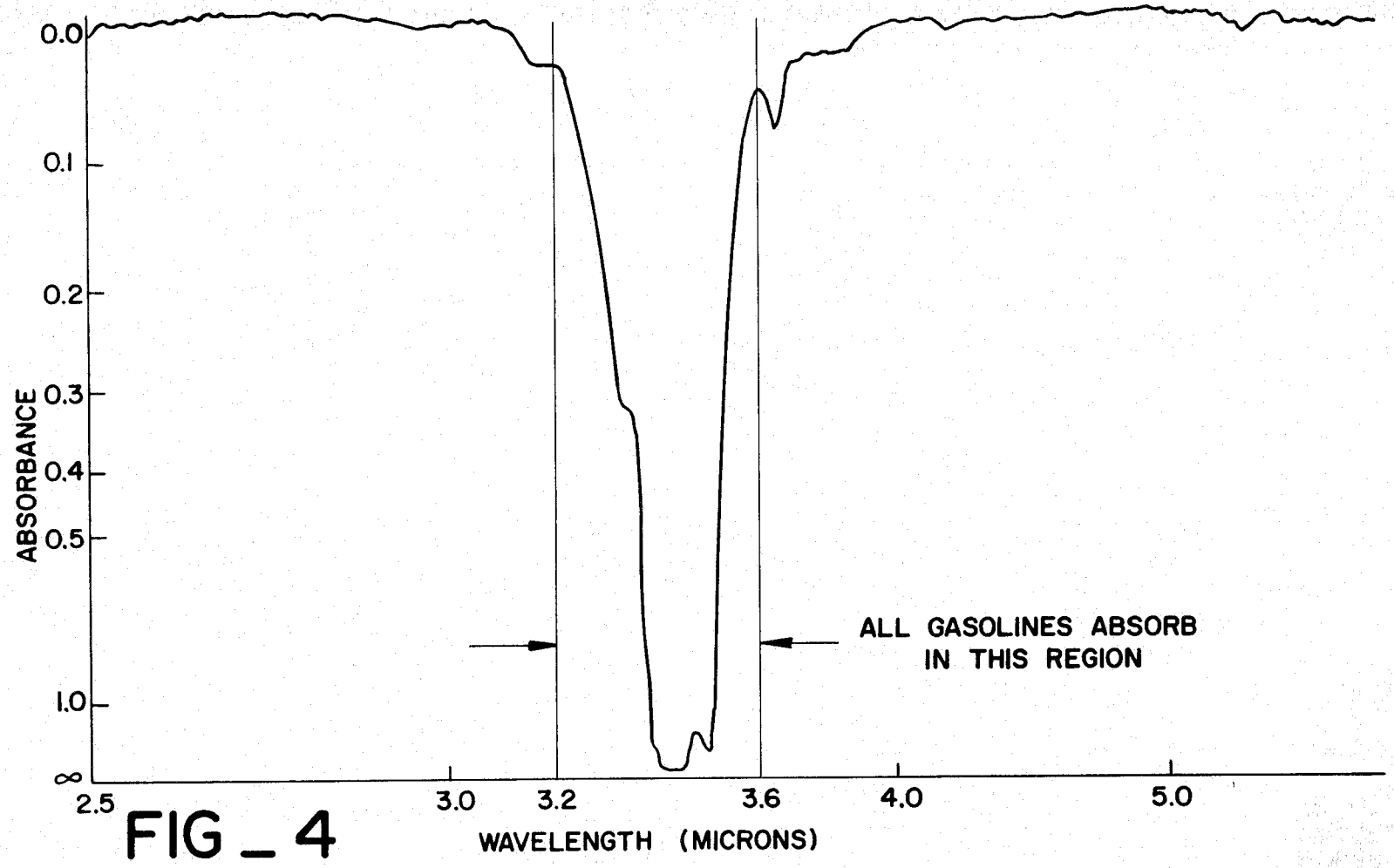
FIG. 4 is a graph that illustrates the ability of gasoline to absorb light in the near infrared spectrum.

As indicated, the fuel present in detector gap 70 blocks the passage of light across the detector gap to cause receiver 52 to operate a fuel flow shutoff means to automatically stop the flow of fuel into the tank being filled. The reason that light does not reach receiver 52 when fuel is present in detector gap 70 is that the fuel absorbs essentially all of the light passing out of conduit 56. This is illustrated in the graph of FIG. 4 where the absorbance of light by gasoline is plotted on the ordinate and the wavelength of the particular light source is plotted on the abscissa. For light in the near infrared (IR) spectrum and in particular for light having a wavelength of between approximately 3.2 and 3.6 microns, gasoline will essentially absorb all light transmitted. Accordingly, light source 50 of the present invention will be designed to transmit light having a wavelength of approximately between 3.2 and 3.6 microns. Therefore, when fuel, for example, gasoline or diesel, is present in detector gap 70 light transmitted by light source 50 will be prevented from passing across gap 70 as the fuel in chamber 67 will substantially absorb all of the light.

Another means for shutting off the flow of fuel into the tank being filled is shown in FIG. **3*b*. Here, the fuel flow shutoff means comprises a normally closed, electrically activated valve 130 arranged in that portion of flow passage 16 in the fuel dispenser. In this arrangement, a dispense switch 120 is appropriately connected to pump power switch 150 to be opened when switch 150 is opened and to be closed when switch 150 is closed. With switch 150 closed, the pump is on and switch 120 is closed to turn on light source 50 and to supply power to valve 130 through closed relay 57. Valve 130 will be in its open position so long as power is supplied to it through relay 57, and normally open relay 57 will remain in its closed position so long as power is being supplied to it by the receiver's photocell. But when fuel enters detector gap 70 through port 60, relay 57 will open, as discussed heretofore, to prevent power from being supplied to valve 130. This will cause valve 130 to close. When valve 130 is closed, fuel flow from the fuel supply will be stopped. In the above manner, the present invention may operate to automatically prevent the flow of fuel into the tank being filled when the fuel rises to a level sufficient to enter chamber 67 through port 60, blocking the passage of light across detector gap 70**.

It is noted that the light source and light receiver are preferably mounted on the dispenser or at least at some point remote from the fuel nozzle. This is to prevent the possibility of electrical sparking near the fuel flow. It is also noted that the fuel flow shutoff means could be various other configurations for stopping fuel flow when the passage of light across the detector gap is prevented by the presence of fuel in the chamber. It is further noted that the light source 50 could be connected to the 115 VAC power supply so that the light source is always on.

SUMMARY OF THE ADVANTAGES

The fibre optic automatic shutoff system of the present invention offers a relatively simple arrangement that is relatively inexpensive to manufacture and maintain.

Although certain specific embodiments of the invention have been described in detail, the invention is not to be limited to only such embodiments but rather by the appended claims.

What is claimed is:

1. A method for use with a fuel-dispensing system to automatically stop fuel flow into a fuel tank being filled when the level of fuel in the tank reaches a predetermined level, said fuel dispensing system including a fuel dispensing nozzle having a main body portion, a discharge spout projecting from the main body portion, said discharge spout having an outlet end proportioned for each of insertion into a fill pipe of the fuel tank, a fuel dispenser, a fuel hose connected between the nozzle main body portion and said dispenser, and a flow passage extending through said discharge spout, the nozzle main body portion, said fuel hose, and said dispenser for the flow of fuel therethrough, comprising:

forming a housing in said flow passage near the outlet end of said discharge spout to define a chamber wherein fuel may only enter said chamber through an opening in the lower surface of said discharge spout;

extending two light guides from the fuel dispenser and through the flow passage into said chamber to define a detector gap therein;

transmitting light having a wavelength between approximately 3.2 and 3.6 microns from a light source through one of said light guides to said detector gap;

receiving light at a light receiver from said detector gap through a second one of said light guides; and automatically stopping fuel flow when the level of fuel in the tank being filled rises above a level sufficient to enter said chamber so that the passage of light from said light source across said detector gap to said light receiver is prevented by the presence of fuel in said detector gap.

2. A method for use with a fuel-dispensing system to automatically stop fuel flow into a fuel tank being filled when the level of fuel reaches a predetermined level, said fuel dispensing system including a fuel dispensing nozzle having a main body portion, a discharge spout projecting from the main body portion, said discharge spout having an outlet end proportioned for ease of insertion into a fill pipe of the fuel tank, a fuel dispenser, a fuel hose connected between the nozzle main body portion and said dispenser, and a flow passage extending through said discharge spout, the nozzle main body portion, said fuel hose, and said dispenser for the flow of fuel therethrough, comprising:

locating a fibre optic light source at said fuel dispenser;

forming a housing in said flow passage near the outlet end of said discharge spout to define a chamber with a portion of the walls of said discharge spout wherein fuel may only enter said chamber through an opening in the lower surface of said discharge spout;

extending a first fibre optic light guide from said light source through said flow passage and into said chamber;

locating a fibre optic light receiver at said dispenser;

extending a second fibre optic light guide from said light receiver through said flow passage and into said chamber to define with said first light guide a detector gap;

locating a fuel-flow shutoff means at said fuel dispenser for preventing fuel flow into the fuel tank being filled when the level of fuel in the tank rises above a level sufficient to enter said chamber to be present in said detector gap;

transmitting light having a wavelength between approximately 3.2 and 3.6 microns from said light source to said light receiver by way of said first and second light guides across said detector gap when said fuel dispenser is activated; and automatically closing said shutoff means by means of said light receiver to stop fuel flow when the passage of light from said light source to said light receiver is blocked by the presence of fuel in said detector gap.

* * * * *

UNITED STATES PATENT AND TRADEMARK OFFICE

CERTIFICATE OF CORRECTION

PATENT NO. : 4,503,994

DATED : March 12, 1985

INVENTOR(S) : Walter R. Pyle

It is certified that error appears in the above-identified patent and that said Letters Patent are hereby corrected as shown below:

Claim 1, Col. 5, line 40, "each of" should read --ease of--.

Signed and Sealed this

*Second* Day of *July 1985*

[SEAL]

*Attest:*

DONALD J. QUIGG

*Attesting Officer* *Acting Commissioner of Patents and Trademarks*